US006916104B2

(12) United States Patent
Parsons et al.

(10) Patent No.: US 6,916,104 B2
(45) Date of Patent: Jul. 12, 2005

(54) ADJUSTABLE FLASHLIGHT HANDSTRAP

(75) Inventors: Kevin L. Parsons, Appleton, WI (US); Mark A. Zimmerman, Brussels (BE)

(73) Assignee: Armament Systems & Procedures, Inc., Appleton, WI (US)

( * ) Notice: Subject to any disclaimer, the term of this patent is extended or adjusted under 35 U.S.C. 154(b) by 65 days.

(21) Appl. No.: 10/610,470

(22) Filed: Jun. 30, 2003

(65) Prior Publication Data

US 2004/0037072 A1 Feb. 26, 2004

Related U.S. Application Data

(63) Continuation-in-part of application No. 09/658,033, filed on Sep. 8, 2000, now abandoned.

(51) Int. Cl.[7] ..... F21V 21/40; F21L 4/00

(52) U.S. Cl. ..... 362/191; 362/396; 362/109

(58) Field of Search ..... 362/191, 382, 362/396, 190, 399, 109, 103, 208, 253, 430, 439

(56) References Cited

U.S. PATENT DOCUMENTS

| | | | | | |
|---|---|---|---|---|---|
| 1,325,885 | A | | 12/1919 | Weber | 340/321 |
| 1,769,241 | A | | 7/1930 | Stephani | 362/103 |
| 3,273,766 | A | | 9/1966 | Cosentino | 224/197 |
| 3,550,824 | A | | 12/1970 | Bohanski | 224/197 |
| 4,020,985 | A | * | 5/1977 | Halterman | 224/251 |
| 4,286,311 | A | | 8/1981 | Maglica | 362/205 |
| 4,351,526 | A | | 9/1982 | Schwartz | 482/108 |
| 4,508,249 | A | * | 4/1985 | Kotchy | 362/191 |
| 4,718,126 | A | | 1/1988 | Slay | 362/105 |
| 4,970,631 | A | * | 11/1990 | Marshall | 362/191 |
| 4,984,724 | A | * | 1/1991 | Johnston | 362/108 |
| 5,052,602 | A | | 10/1991 | Duchi, Jr. et al. | 224/218 |
| 5,135,455 | A | | 8/1992 | King et al. | 482/108 |
| 5,325,997 | A | | 7/1994 | Washington et al. | 222/175 |
| 5,593,074 | A | | 1/1997 | Matthews | 224/251 |
| 5,642,932 | A | * | 7/1997 | Matthews | 362/206 |
| D381,805 | S | | 8/1997 | Case | D3/229 |
| 5,752,633 | A | | 5/1998 | Antaki | 224/222 |
| 5,921,657 | A | * | 7/1999 | Case | 362/191 |
| 5,957,515 | A | | 9/1999 | Van Der Sluys | 294/25 |
| 5,971,240 | A | | 10/1999 | Dequaine | 224/217 |

* cited by examiner

*Primary Examiner*—Thomas M. Sember
*Assistant Examiner*—Bao Q. Truong
(74) *Attorney, Agent, or Firm*—Welsh & Katz, Ltd.

(57) ABSTRACT

A handstrap for hand support of a flashlight having an elongated body, a head end and a tailcap includes a relatively rigid generally annular attachment element for mounting on the flashlight body, and a strap having an end secured to an elastomeric generally annular retaining member adapted for releasable mounting on the flashlight body. With the attachment element mounted on the flashlight body and the flashlight gripped in the palm of the user's hand with the fingers generally encircling the flashlight body, and with a free end of the strap looped about the attachment element, the elastomeric retaining member is attached to the flashlight body so that the strap overlies the back of the hand. The free end of the strap is then drawn through the attachment element in a manner enabling the strap to be folded back upon and secured to itself so as to snugly retain the flashlight in the palm of the user's hand.

21 Claims, 3 Drawing Sheets

ADJUSTABLE FLASHLIGHT HANDSTRAP

This is a continuation-in-part from application Ser. No. 09/658,033, filed Sep. 8, 2000, now abandoned which is incorporated herein by reference.

BACKGROUND OF INVENTION

Field of the Invention

This invention relates generally to equipment retaining devices, and more particularly to a handstrap for strapping a flashlight to the hand of a user.

For years, law enforcement personnel, such as police officers, have used flashlights to assist them with their law enforcement duties. Most personnel carry flashlights in their vehicles at all times to insure that a flashlight is available when one encounters dark, foggy, smoky, or other poor visibility settings. In fact, many officers carry a holstered flashlight to insure that a flashlight is on their person and available at all times. Often law enforcement personnel are required to enter dangerous areas under darkened or poor visibility conditions. In some situations an officer may carry his flashlight in one hand and keep his other hand ready to unholster either an expandable baton or handgun depending on the circumstances. In other more dangerous situations, it is important for the officer to have the ability to carry a drawn gun and illuminate the area at the same time. While some guns may be equipped with a light source, it is impracticable or undesirable for most handguns to include a light source because it can create holstering problems, and make the gun heavier and more cumbersome. As a result, it is often necessary for an officer to carry both a gun and a flashlight. Typically in such situations, an officer will carry a handgun in one hand and a flashlight in the other.

It is often desirable that both the flashlight and the gun are pointed or aimed in the same direction to ensure that the target of the officer is illuminated. Some methods have been developed to insure that the flashlight is properly pointed or directed to illuminate the target at which the gun is aimed where a flashlight is held in one hand and a handgun in the other. One such method is known as "the Harries technique" and involves holding the handgun with one hand, "the gun hand," and holding the flashlight in the other hand, "the flashlight hand." The flashlight hand is crossed under the wrist of the gun hand and the back of the flashlight hand is pressed against the back of the gun hand for illumination of the target and stabilization of the gun hand. Such flashlights typically have intermittent or "deadman" switches that turn off when activation pressure is released. This prevents the flashlight from illuminating the officer, or identifying the location of the officer, should he become injured or unconscious.

Whether an officer carrying a flashlight in one hand is carrying a handgun or expandable baton in the other or not, the officer must be prepared to protect himself against attack by an assailant, and against attempts to disarm the officer. In the event of an attack, many officers are trained to drop their flashlight to enable the officer to fend off an attacker with a free hand. However, there are several disadvantages that may result from this practice. When a flashlight is dropped, it may be become damaged from the fall, particularly if it lands on concrete or some other hard surface. In addition, under darkened conditions, the officer may not be able to readily locate the dropped flashlight. It may be of critical importance for the officer to retrieve his flashlight to locate his attacker or to illuminate a fleeing assailant. If the flashlight has been damaged in the fall, or the officer is unable to locate the dropped flashlight, the assailant may be able to successfully mount an attack or flee the scene.

In the prior art, a lanyard is available that can be attached to a flashlight to allow the flashlight to dangle from the user's wrist or neck. In U.S. Pat. No. 5,642,932, a lanyard is disclosed that can be looped around the user's wrist to allow the flashlight to dangle when the flashlight is not in use. While a lanyard is useful for keeping the flashlight with the user when not in use, the use of a lanyard of this type has several drawbacks. A flashlight dangling from the wrist of an officer may provide an assailant with the ability to grab onto either the lanyard or flashlight to control or subdue the officer. For example, an attacker can grab hold of the lanyard and pull the officer towards the attacker or throw the officer to the ground. The lanyard can be turned against the officer and used to the advantage of an attacker. In addition, it is difficult for an officer to regain control of the dangling flashlight. The officer typically must swing the flashlight up in the air and catch it with the same hand to regain control of the flashlight. This can be very difficult in darkened conditions, and may require the officer to use his other hand to assist in regaining control of the flashlight. This becomes even more dangerous when the other hand is holding a handgun. Accordingly, there is a need to provide a way for an officer to quickly, efficiently, and safely regain or retain the use of a flashlight following an altercation.

SUMMARY OF THE INVENTION

The present invention is specifically directed to a handstrap for strapping a flashlight to the hand of the user. In the disclosed embodiment, one end of the strap is secured to the flashlight on the tail end or body of the flashlight. With the user's hand grasping the body of the flashlight, the strap is placed over the back of the user's hand and the other end of the strap is removably attached to the head end of the flashlight. In this manner, the flashlight is held in the palm of the user's hand and strapped in place by the handstrap of the present invention.

In a preferred embodiment of the invention, one end of the handstrap is comprised of a metal attachment ring that is secured to the body of the flashlight between the body and the tailcap. However, the use of such an attachment ring is just one of many options to secure the strap to the flashlight. There are many different ways in which the hand strap could be secured to the body of end of the flashlight. For example, the strap could snapped, clamped, tied, or secured in any other conventional manner to the flashlight.

The handstrap is preferably adjustable in length to allow the strap to be adjusted to a variety of hand sizes. In a preferred embodiment, the strap includes a Velcro® surface of the hook and loop variety. The length of the strap is adjusted by passing the strap through the attachment ring a desired distance and then folding the strap back onto itself to secure the Velcro® connection.

The other end of the strap is preferably secured to a removable retaining member. In a preferred embodiment, the retaining member is an elastomeric shock cord or cord-ring adapted to fit over the head of the flashlight. The diameter of the cord-ring is preferably slightly smaller than the diameter of the flashlight head to necessitate the cord-ring to be stretched over the flashlight head. The elastomeric cord-ring allows for some flex in the handstrap to accommodate the hand in both a relaxed or open state and a clenched and closed state.

In an alternate equivalent embodiment, the attachment member could be secured to the flashlight near the head end of the flashlight and the retaining member could be placed over the tailcap of the flashlight. Thus, what has and will be described as the "retaining member" can also be used to attach the second end of the strap to the tailcap or tail section of the flashlight, in addition to the head.

The present invention eliminates the drawbacks and disadvantages of the prior art. The handstrap of the present invention allows an officer to hold a flashlight in one hand with the flashlight securely strapped to the palm of the hand. The officer is able to open his hand to fend off an attacker while the flashlight remains securely strapped to his hand. The officer can also still use the flashlight hand to pickup, move or deflect objects, open a door, or to control a subject. In this manner, the officer is able to retain control of the flashlight at all times. After fending off an attacker, the officer is immediately able to use the flashlight to illuminate the area and the attacker.

BRIEF DESCRIPTION OF THE DRAWINGS

Further advantages of the present invention will become apparent to those skilled in the art with the benefit of the following detailed description of the preferred embodiments and upon reference to the accompanying drawings in which.

Figure 1:
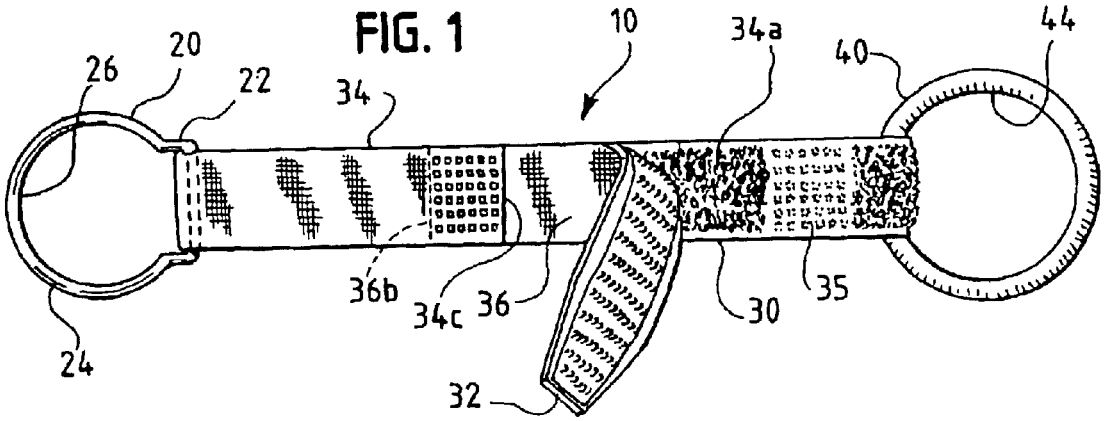
FIG. 1 is a plan view of the flashlight handstrap in accordance with the present invention shown with the strap attached to the attachment ring and folded back upon itself.

While the invention is susceptible to various modifications and alternative forms, specific embodiments thereof are shown by way of example in the drawings and will herein be described in detail. It should be specifically understood with respect to the drawings, that the drawings are of a preferred embodiment, and there are many other embodiments and forms in which the present invention may appear. It should also be understood that the drawings and detailed description thereof are not intended to limit the invention to the particular form disclosed, but on the contrary, the invention is to cover all modifications, equivalents and alternatives falling within the spirit and scope of the present invention or within the scope of the appended claims.

DETAILED DESCRIPTION OF THE PREFERRED EMBODIMENT

Figure 2:
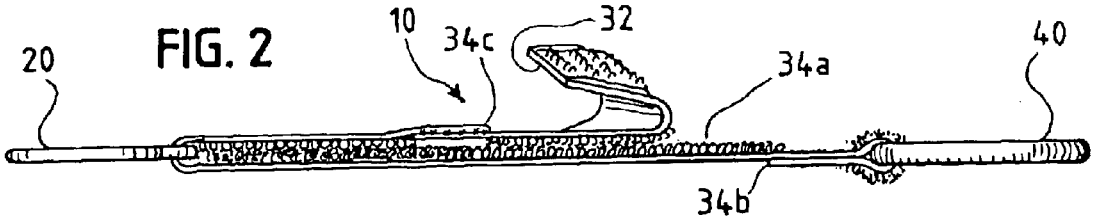
FIG. 2 is a side edge view of the flashlight handstrap of FIG. 1.
Figure 3:
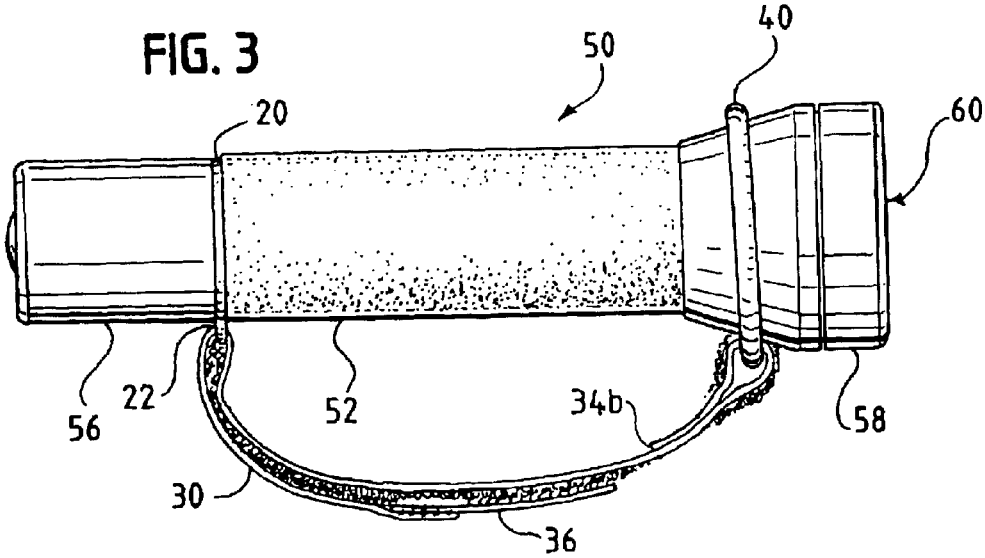
FIG. 3 is a side view of the flashlight handstrap attached to a flashlight.
Figure 4:
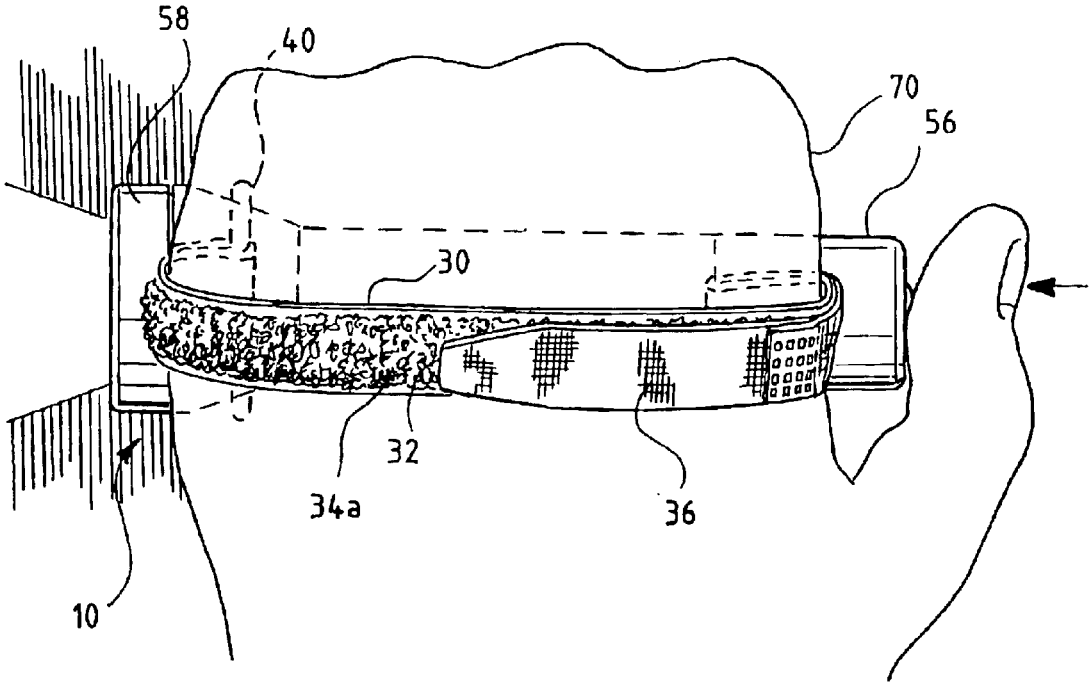
FIG. 4 illustrates a flashlight strapped into the palm of a hand using the flashlight handstrap of FIG. 1.

A flashlight handstrap 10 made in accordance with the principles of the present invention is depicted in FIGS. 1–7. As shown in FIG. 1, handstrap 10 includes a flashlight attachment element 20 that may be adapted to fit over the body section of a flashlight. Attachment element 20 may be comprised of any number of different attachment mechanisms, such as a clasp, clamp, tie, snap, etc. that are suitable for attachment to a flashlight. Preferably, attachment element 20 is an attachment ring that is adapted to fit over the body section of a flashlight. As shown in FIGS. 3 and 4, most preferably attachment element 20 is made of welded steel wire and is generally round with an external diameter 24 equal to the diameter of the flashlight body and an internal diameter 26 that is large enough to fit over a threaded portion 54 of the flashlight body 52 or threaded portion of tailcap 56. The base of the externally threaded portion may include a neoprene 0-ring. Attachment element 20 may be smaller than the neoprene 0-ring to allow the 0-ring to hold the attachment element in place while the tailcap is removed to change batteries. Flashlight tailcap 56 having internal threads 59 is adapted to mate with the threaded portion 54 of flashlight body 52. When tailcap 56 is screwed onto the flashlight body 52, attachment ring 20 is positioned between the body 52 and the tailcap 56, and thus securely attached to flashlight 50. It will be understood that the threading could be reversed such that the tailcap would include external threads and the body section internal threads. In the disclosed embodiment, the handstrap may be easily secured to the flashlight by simply removing the tailcap, placing the attachment element over the externally threaded portion, and replacing the tailcap. Similarly, the handstrap can be easily removed by simply unscrewing the tail cap, removing the attachment element, and replacing the tailcap. Thus, the present invention provides a simple and efficient method of attaching or removing the handstrap as needed.

Figure 3A:
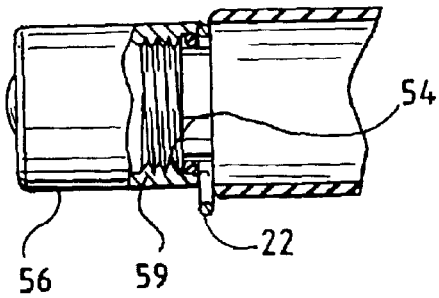
FIG. 3A is a fragmentary view of the flashlight tail section, body section, and the attachment element, portions being broken away for clarity.

Attachment element 20 may include a strap retention extension 22 adapted to allow for the passage of a leading edge 32 of strap 30. As shown in FIG. 3A, strap retention extension 22 of attachment ring 20 extends slightly from the flashlight body 52 to allow for the passage of strap 30 therethrough. A suitable flashlight for use with the handstrap of the present invention is disclosed in U.S. Pat. No. 6,045,237, the disclosure of which is herein incorporated by reference.

The strap 30 may be attached to the strap retention extension 22 of attachment ring 20. Strap 30 includes a first substrate length or section 34 having a Velcro® loop surface 34*a* that is designed to mate with a corresponding Velcro® hook surface 36*a* formed on a second substrate length of the strap indicated at 36 which defines a front portion of the strap. The strap section 34 extends from an end 34*b* to an opposite end 34*c*. The strap length 36 having the hook surface 36*a* thereon extends from its leading edge 32 to an opposite end 36*b*. A portion of the strap length 36 adjacent the end 36*b* is juxtaposed to the strap section 34 adjacent its end 34*c*, and the juxtaposed or overlying strap portions are preferably sonic welded together.

In a preferred embodiment, the cord substrate is made of Lea & Sachs #9006 black elastic material, where the cord is 56% rubber and 44% yarn. Such a cord has rubber thread that is 1800 natural latex and the yarn is 150/2 black polyester. The cord is preferably one-eight inch thick with a weight of 29 ounces per 144 yards and the elongation is 150%.

Using the Velcro® strap 30, the effective length of the strap can be modified by adjusting the length of the strap that is passed through the strap retention extension 22 before the strap is folded back upon itself and the hook surface 36*a* attached to the loop surface 34*a*. Thus, the handstrap of the present invention is adjustable in length and can be adapted to accommodate a multitude of different users have varying hand sizes. In addition, the strap can be adjusted after it has been attached to the attachment element 20 and placed on the back of the user's hand by lifting the strap front portion 36, pulling the strap further through the strap retention extension 22 until the desired tension on the hand is achieved, and then folding the strap front portion 36 back upon the Velcro® loop surface 34*a* to complete the Velcro® connection. While the use of Velcro® is used in the preferred embodiment, any number of other known attachment techniques can be used to provide for the adjustability of the length of the strap. Other methods of adjusting the strap may also be employed without departing in any way from the spirit and scope of the invention. Strap front portion 36 is attached to the Velcro® loop section 34 of the strap by means of sewing, gluing, bonding or, as noted, preferably by sonic welding. In addition, the strap is preferably, but by no means required, comprised of Velcro® brand or 3M brand ¾ inch wide black hook and loop closure material.

As shown in FIGS. 1–3, flashlight handstrap 10 further includes retaining member 40. In a preferred embodiment, retaining member 40 is an elastic cord-ring. Many other members suitable for attachment to an end of a flashlight can be used without departing from the invention. Most preferably, the cord-ring is comprised of a suitable length of a circular cross-section neoprene having its abutting ends secured or joined together by cyanocrylate adhesive so as to form an elastic ring having a diameter of approximately 1¾". Retaining member 40 has an internal diameter 44 preferably smaller than an outer diameter 60 of flashlight head 58. A length of strap 34 adjacent its end 34*b* is looped about the retaining member 40 and secured in juxtaposed relation to itself by sonic welding at 35. In operation, retaining member 40 is placed over the flashlight head 58 allowing space for the hand of a user to slip between strap 30 and flashlight body 52.

Figure 5:
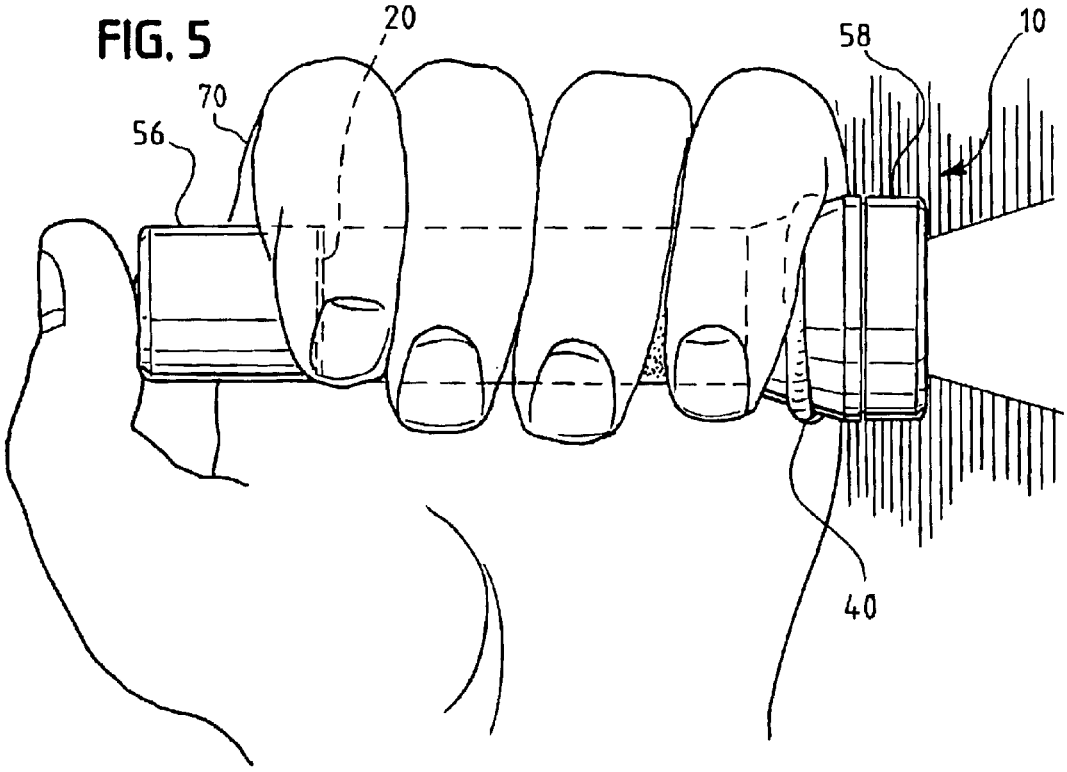
FIG. 5 illustrates a flashlight strapped into the palm of a hand using the flashlight handstrap of FIG. 1 viewed as showing the user's fingers partially encircling the flashlight.

FIGS. 4 and 5 depict the flashlight handstrap of the present invention in operation. Although the flashlight is shown in the user's left hand 70, the present invention can be used with either hand. The user's thumb is used to operate a pushbutton switch located at the end of flashlight tailcap 56 to operate the flashlight. With the strap 30 secured to the attachment element or ring 20 mounted on the flashlight, the user's hand 70 is positioned between the flashlight and strap 30. Retaining member 40 is then positioned about flashlight head 58 to complete attachment of the strap to the flashlight. Strap portion 36 can be released and again adjustably secured to the Velcro® loop surface 34*a* to draw the strap snugly across the back of the hand. As aforenoted, the attachment element or ring 20 can alternatively be secured to the flashlight near the head end of the flashlight, and the retaining member 40 placed over the tailcap of the flashlight.

When the flashlight is positioned in the hand in this manner, an officer may hold a handgun in his other hand and use the Harries technique to simultaneously illuminate the target at which the gun is aimed. With the thumb positioned directly adjacent the pushbutton switch located at the end of flashlight tailcap 56, the user is able to easily, quickly, and efficiently operate the flashlight in a desired fashion. The flashlight can be easily removed from the hand by removing retaining member 40 from flashlight head 58. The hook and loop strap allows for rapid adjustment to various hand sizes and rapid modification should the officer put on gloves.

Figure 6:
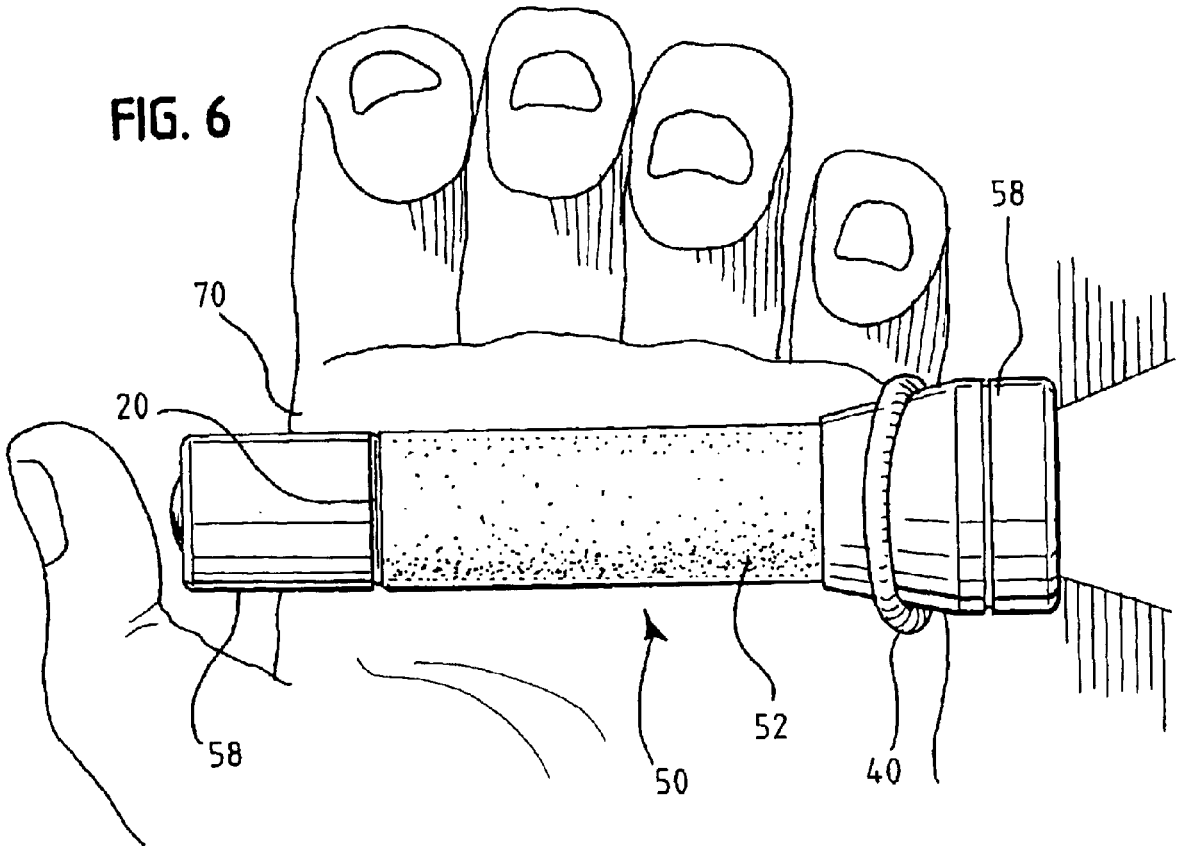
FIG. 6 is a view similar to FIG. 5, but showing the flashlight secured to user's hand but with the user's finger in an open position.
Figure 7:
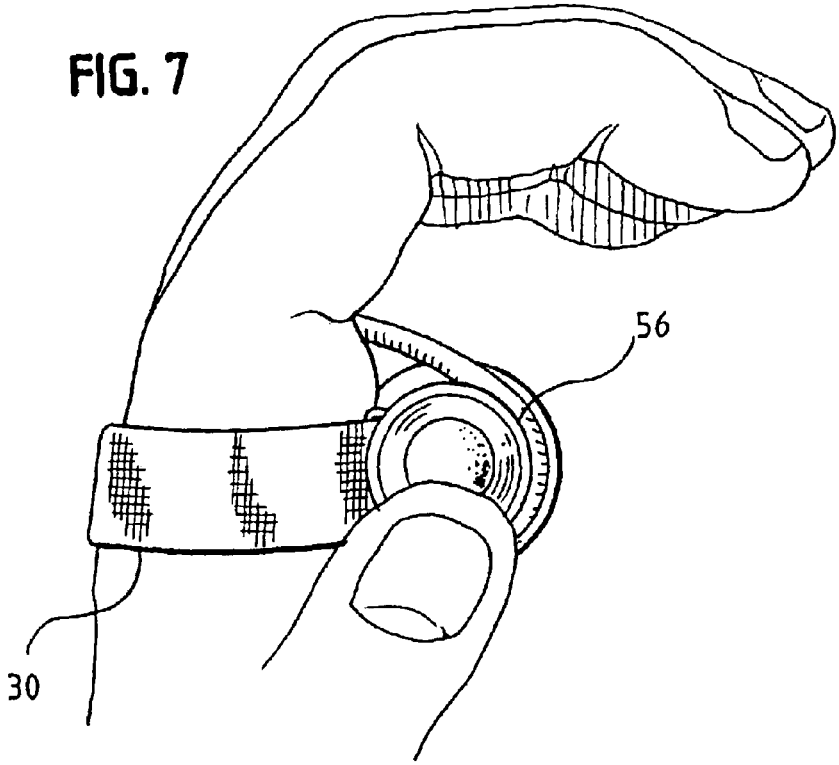
FIG. 7 is a side view of FIG. 6.

FIGS. 6 and 7 further depict the flashlight 50 strapped to the hand of the user. The body section 52 is positioned in the palm of the user's hand. As shown, the user may open the hand completely, straightening the fingers and thumb, and the flashlight is still held securely in place against the user's palm. In this manner, an officer is free to use the hand to fend off an attacker. As soon as an attack has been parried, the officer is immediately able to use the flashlight to illuminate the area or assailant as necessary. Unlike flashlights attached to the user's wrist via a lanyard, where an officer must fumble blindly to regain control of the flashlight, the present invention allows the flashlight to remain at the ready, directly strapped to the user's hand. The thumb remains in close proximity to the pushbutton switch allowing the officer to quickly operate the flashlight as needed.

In addition, because the flashlight does not dangle from the officer's arm, an assailant cannot grab the flashlight to gain control over the officer. Nor does the preferred embodiment of the invention utilize a lanyard that an assailant could grab to subdue the officer. For these reasons, the present invention has a distinct advantage over the prior art by providing an officer with a way to safely and quickly regain or maintain control of a flashlight.

While certain features and embodiments of the invention have been described herein, it will be readily understood that the invention encompasses all modifications and enhancements within the scope and spirit of the present invention.

What is claimed is:

1. A handstrap for hand support of a flashlight of the type having a generally cylindrical body portion, a head portion disposed on an end of the cylindrical body portion, and a tailcap on an opposite end of the body portion, said handstrap comprising a relatively rigid attachment element adapted for attachment to the body portion so as encircle the body portion, a generally annular retaining member adapted to be stretched to enable placement over the head portion or placement about the body portion indenendently from and in spaced relation to said attachment element, and an elongated strap having a first end secured to said retaining member and a second end adapted for mutual cooperation with said attachment element so as to enable the strap to be connected to the attachment element a selected distance from the retaining member, whereby a user can connect the second end of the strap to the attachment element, attach the attachment element to the body portion, grasp the flashlight in the palm of a hand, stretch the retaining member over a selected one of the flashlight head and body portions with the user's free hand so that the strap overlies the user's flashlight grasping hand, and selectively adjust the connection of the strap to the attachment element in a manner to enable the strap to be drawn taut over the back of the user's flashlight grasping hand and releasably secured in overlying relation to itself.

2. A handstrap for hand support of a flashlight of the type having a generally cylindrical body portion, a head portion disposed on an end of the cylindrical body portion, and a tailcap on an opposite end of the body portion.

said handstrap comprising a relatively rigid attachment element adapted for attachment to the body portion so as encircle the body portion, a generally annular cord-ring adapted to be stretched to enable placement over the head portion or placement about the body portion in spaced relation to said attachment element, and an elongated strap having a first end secured in fixed relation to said cord-ring and a second end adapted for mutual cooperation with said attachment element so as to enable the strap to be connected to the attachment element a selected distance from the cord-ring, whereby a user can connect the second end of the strap to the attachment element, attach the attachment element to the body portion, grasp the flashlight in the palm of a hand, stretch the cord-ring over a selected one of the flashlight head and body portions with the user's free hand so that the strap overlies the user's flashlight grasping hand, and selectively adjust the connection of the strap to the attachment element in a manner to enable the strap to be drawn taut over the back of the user's hand and releasably secured in overlying relation to itself.

3. A handstrap as defined claim 2, wherein the cord-ring is defined by an endless elastic circular member.

4. A handstrap as defined in claim 1 wherein the retaining member is permanently attached to the first end of the strap.

5. A handstrap as defined in claim 1 wherein the attachment element is adapted to be positioned in sandwich fashion between the flashlight body and the tailcap.

6. A handstrap for hand support of a flashlight of the type having a generally cylindrical body portion, a head portion disposed on an end of the cylindrical body portion, and a tailcap on an opposite end of the body portion, said handstrap comprising a relatively rigid metallic ring adapted for attachment to the body portion so as to encircle the body portion, a generally annular retaining member adapted to be stretched to enable placement over the head portion or placement about the body portion in spaced relation to said metallic ring, and an elongated strap having a first end secured to said retaining member and a second end adapted for mutual cooperation with said metallic ring so as to enable the strap to be connected to the metallic ring a selected distance from the retaining member, whereby a user can connect the second end of the strap to the metallic ring, attach the metallic ring to the body portion, grasp the flashlight in the palm of a hand, stretch the retaining member over a selected one of the flashlight head and body portions with the user's free hand so that the strap overlies the user's flashlight grasping hand, and selectively adjust the connection of the strap to the metallic ring in a manner to enable the strap to be drawn taut over the back of the user's hand and releasably secured in overlying relation to itself.

7. A flashlight handstrap as defined in claim 5 wherein the flashlight body is substantially tubular, said annular retaining member having a non-stretched diameter generally equal to the diameter of the flashlight body.

8. A flashlight handstrap as defined in claim 6 wherein the attachment element includes a strap retention extension for looped connection with the strap.

9. A handstrap as defined in claim 1 wherein a portion of the strap includes a hook surface and another portion of the strap includes a loop surface, said hook and loop surfaces being mutually cooperable when the strap is looped about the attachment element and folded in overlying relation upon itself whereby to enable the length of the strap between the attachment element and the retaining member to be selectively varied.

10. The flashlight handstrap of claim 8, wherein a selected length of the strap includes a hook surface and another length of the strap includes a loop surface so that the strap may pass through the strap retention extension and be folded back upon itself to interconnect the hook and loop surfaces and secure the strap to the attachment element.

11. A handstrap as defined in claim 1 wherein said annular retaining member has a normal non-stretched circumferential length less than the circumference of the enlarged head portion of the flashlight.

12. A handstrap as defined in claim 1 wherein said strap has a first portion on which is formed a loop surface, and has a second portion that includes a hook surface, said loop and hook surfaces being mutually cooperative to retain the strap in a fixed length loop over the back of the user's hand when the second end of the strap is drawn taut and disposed in contacting overlying relation to itself.

13. A handstrap as defined in claim 3 wherein said strap includes a first length of substrate on which said loop surface is formed, and a second length of substrate on which said hook surface is formed, an end of said first length of substrate being secured to an end of said second length of substrate.

14. A handstrap as defined in claim 13 wherein said first and second lengths of substrate are interconnected in axially aligned relation by sonic welding.

15. A handstrap for hand support of a flashlight of the type having a generally cylindrical body portion, a head portion disposed on an end of the cylindrical body portion, and a tailcap on an opposite end of the body portion;

said handstrap comprising a relatively rigid attachment element adapted for attachment to the body portion so as encircle the body portion;

a generally annular elastomeric cord adapted to be stretched to enable placement over the head portion or placement about the body portion in spaced relation to said attachment element, said elastomeric cord being of a predetermined length having opposite ends connected in abutting relation by cyanocrylate adhesive; and an elongated strap having a first end secured to said elastomeric cord and a second end adapted for mutual cooperation with said attachment element so as to enable the strap to be connected to the attachment element a selected distance from the elastomeric cord, whereby a user can connect the second end of the strap to the attachment element, attach the attachment element to the body portion, grasp the flashlight in the palm of a hand, stretch the elastomeric cord over a selected one of the flashlight head and body portions with the user's free hand so that the strap overlies the users flashlight grasping hand, and selectively adjust the connection of the strap to the attachment element in a manner to enable the strap to be drawn taut over the back of the user's flashlight grasping hand and releasably secured in overlying relation to itself.

16. A handstrap in combination with a flashlight having a head end and an opposite removable tailcap end, said handstrap comprising:

a generally rigid attachment element adapted for attachment to the flashlight so as to be retained in fixed relation along the longitudinal length of the flashlight by the tailcap, the attachment element including a substantially circular ring having a strap retention extension;

a strap having first and second ends, said first end being connected to said strap retention extension; and a retaining member connected to the second end of the strap, said retaining member comprising a stretchable cord-ring having a diameter sufficient to allow the cord-ring to be placed over the head end of the flashlight when the strap is connected to the attachment element attached to the flashlight so that the strap forms a loop across the back of a user's hand that can be drawn taut when grasping the flashlight.

17. The handstrap as defined in claim 16, wherein a portion of the strap includes a hook surface and another portion of the strap includes a loop surface so that the strap may pass through the strap retention extension and be folded back upon itself to secure the strap with the attachment element.

18. A flashlight handstrap assembly wherein the flashlight has a head section, a body section, and a tail section having a tailcap releasably mounted thereon;

said handstrap assembly including a substantially rigid generally circular attachment element adapted to be mounted on the flashlight body section and retained thereon by the tailcap, an elongated flexible strap having first and second ends, and a stretchable circular retaining member, the first end of the strap being adapted for releasable attachment to the attachment element, and the second end of the strap being fixedly attached to the retaining member;

said rigid attachment element being secured to the flashlight between the body section and tail section of the flashlight in generally fixed longitudinal relation on the flashlight, said retaining member being adapted to be stretched over an end of the flashlight opposite the tailcap independently of the attachment element, said strap being connected in looped relation with the attachment element and adapted to extend over the back of a user's hand when the flashlight is held in the palm of the user's hand so as to enable the retaining member to be mounted on the opposite end of the flashlight and the strap looped back upon itself in attached relation so as to draw the flashlight firmly into the user's hand.

19. A method of securing a flashlight in the palm of a user's hand, wherein the flashlight includes a generally cylindrical elongated body and a head portion affixed to an end of the cylindrical body, the method comprising the steps of:

a. mounting a relatively rigid generally annular attachment element on the cylindrical body of the flashlight;

b. securing an elongated strap to the attachment element in a manner such that the strap is looped about the attachment element and can be folded back upon itself, said strap having a generally annular stretchable retaining member affixed to an end thereof spaced from the attachment element so that the retaining member can be mounted on and encircle the flashlight body independently of and in spaced relation to the attachment element;

c. grasping the elongated body of the flashlight in the palm of the user's so that the fingers of the user's hand can at least partially encircle the body of the flashlight and the attachment element is disposed adjacent an edge of the hand;

d. disposing the strap over the back of the hand grasping the flashlight and mounting the retaining member on the body of the flashlight so as to encircle the flashlight adjacent an opposite edge of the hand;

e. adjusting the length of the strap between the attachment element and the retaining member so as to draw a reach of the strap generally taut over the back of the hand grasping the flashlight with a free end reach of the strap overlying the taut reach of the strip; and f. releasably attaching said overlying reach of said strap to said taut reach so as to retain the flashlight snugly against the palm of the user's hand.

20. The method as defined in claim 19 wherein said strap has mutually cooperable surface areas enabling the strap to be releasably attached to the attachment element in a manner enabling the length of strap between the attachment element and retaining member to be selectively varied.

21. The method as defined in claim 20 wherein said mutually cooperable surface areas comprise loop and hook surfaces enabling a first length reach of the strap to be positioned in overlying relation to a second length reach of the strap and secured thereto through interconnection of said loop and hook surfaces.

* * * * *